US007943283B2

(12) United States Patent
Lai et al.

(10) Patent No.: US 7,943,283 B2
(45) **Date of Patent: *May 17, 2011**

(54) TONER COMPOSITIONS

(75) Inventors: Zhen Lai, Webster, NY (US); Yuhua Tong, Webster, NY (US); Christopher M. Wolfe, Webster, NY (US); Chieh-Min Cheng, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1182 days.

This patent is subject to a terminal disclaimer.

(21) Appl. No.: 11/642,199

(22) Filed: Dec. 20, 2006

(65) Prior Publication Data

US 2008/0153025 A1 Jun. 26, 2008

(51) Int. Cl.
*G03G 9/093* (2006.01)

(52) U.S. Cl. ..... 430/137.11; 430/137.14

(58) Field of Classification Search ..... 430/137.14, 430/137.11

See application file for complete search history.

(56) References Cited

U.S. PATENT DOCUMENTS

| | | | |
|---|---|---|---|
| 2,874,063 | A | 3/1953 | Greig |
| 3,590,000 | A | 6/1971 | Palermiti et al. |
| 3,655,374 | A | 4/1972 | Palermiti et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,265,990 | A | 5/1981 | Stolka et al. |
| 4,394,430 | A | 7/1983 | Jadwin et al. |
| 4,560,635 | A | 12/1985 | Hoffend et al. |
| 4,563,408 | A | 1/1986 | Lin et al. |
| 4,584,253 | A | 4/1986 | Lin et al. |
| 4,797,339 | A | 1/1989 | Maruyama et al. |
| 4,935,326 | A | 6/1990 | Creatura et al. |
| 4,937,166 | A | 6/1990 | Creatura et al. |
| 4,983,488 | A | 1/1991 | Tan et al. |
| 4,996,127 | A | 2/1991 | Hasegawa et al. |
| 5,227,460 | A | 7/1993 | Mahabadi et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 6,004,714 | A | 12/1999 | Ciccarelli et al. |
| 6,190,815 | B1 | 2/2001 | Ciccarelli et al. |
| 6,784,231 | B2 | 8/2004 | Shimada et al. |
| 2002/0187415 | A1 | 12/2002 | Jiang et al. |
| 2002/0192582 | A1 | 12/2002 | Yamazaki |
| 2004/0197693 | A1* | 10/2004 | Ninomiya et al. ..... 430/108.7 |
| 2005/0182168 | A1* | 8/2005 | Bloom et al. ..... 524/313 |
| 2005/0192383 | A1 | 9/2005 | Bloom et al. |
| 2005/0287460 | A1 | 12/2005 | Moffat et al. |
| 2006/0166122 | A1 | 7/2006 | Patel et al. |
| 2008/0063965 | A1* | 3/2008 | Lai et al. ..... 430/108.1 |

FOREIGN PATENT DOCUMENTS

| | | |
|---|---|---|
| EP | 1 568 740 | 8/2005 |
| EP | 1 708 037 | 10/2006 |

OTHER PUBLICATIONS

Grant, R. et al., Grant & Hackh's Chemical Dictionary, Fifth edition, McGraw-Hill Book Company, NY (1987), pp. 628-629.*

European Search Report dated Jun. 24, 2009 for European Patent Appln. No. EP 07 12 3520.

European Examination Report from corresponding Application No. EP 07123520.4 dated Mar. 12, 2010.

* cited by examiner

*Primary Examiner* — Janis L Dote

(74) *Attorney, Agent, or Firm* — Carter, DeLuca, Farrell & Schmidt, LLP

(57) ABSTRACT

Processes for producing toner are provided which utilize reactive coalescing agents in forming the toner particles, as well as toners produced by such processes.

16 Claims, No Drawings

TONER COMPOSITIONS

BACKGROUND

Numerous processes are known for the preparation of toners, such as, for example, conventional processes wherein a resin is melt kneaded or extruded with a pigment, micronized and pulverized to provide toner particles. There are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, the disclosures of each of which are hereby incorporated by reference in their entirety.

Toner can also be produced by emulsion aggregation methods. Methods of preparing an emulsion aggregation (EA) type toner are known and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. In particular, the '943 patent describes a process including: (i) conducting a pre-reaction monomer emulsification which includes emulsification of the polymerization reagents of monomers, chain transfer agent, a disulfonate surfactant or surfactants, and optionally, but in embodiments, an initiator, wherein the emulsification is accomplished at a low temperature of, for example, from about 5° C. to about 40° C.; (ii) preparing a seed particle latex by aqueous emulsion polymerization of a mixture including (a) part of the monomer emulsion, from about 0.1 to about 50 percent by weight, or from about 3 to about 25 percent by weight, of the monomer emulsion prepared in (i), and (b) a free radical initiator, from about 0.5 to about 100 percent by weight, or from about 3 to about 100 percent by weight, of the total initiator used to prepare the latex polymer at a temperature of from about 35° C. to about 125° C., wherein the reaction of the free radical initiator and monomer produces the seed latex comprised of latex resin wherein the particles are stabilized by surfactants; (iii) heating and feed adding to the formed seed particles the remaining monomer emulsion, from about 50 to about 99.5 percent by weight, or from about 75 to about 97 percent by weight, of the monomer emulsion prepared in (ii), and optionally a free radical initiator, from about 0 to about 99.5 percent by weight, or from about 0 to about 97 percent by weight, of the total initiator used to prepare the latex polymer at a temperature from about 35° C. to about 125° C.; and (iv) retaining the above contents in the reactor at a temperature of from about 35° C. to about 125° C. for an effective time period to form the latex polymer, for example from about 0.5 to about 8 hours, or from about 1.5 to about 6 hours, followed by cooling. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, and 5,346,797, the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

Toner systems normally fall into two classes: two component systems, in which the developer material includes magnetic carrier granules having toner particles adhering triboelectrically thereto; and single component systems (SDC), which typically use only toner. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system.

To enable "offset" print quality with powder-based electrophotographic development systems, small toner particles (about 5 micron diameter) may be desired. Although the functionality of small, triboelectrically charged toner has been demonstrated, concerns remain regarding the long-term stability and reliability of such systems.

Development systems which use triboelectricity to charge toner, whether they be two component (toner and carrier) or single component (toner only), may exhibit nonuniform distribution of charges on the surfaces of the toner particles. This nonuniform charge distribution may result in high electrostatic adhesion because of localized high surface charge densities on the particles. For example, the electrostatic adhesion forces for tribo-charged toner, which are dominated by charged regions on the particle at or near its points of contact with a surface, do not rapidly decrease with decreasing size. This so-called "charge patch" effect makes smaller, triboelectric charged particles much more difficult to develop and control. Triboelectricity may also be unpredictable because of the sensitivity of the materials utilized in forming toner.

Improved methods for producing toner, which decrease the production time, and permit excellent control of the charging of toner particles, remain desirable.

SUMMARY

The present disclosure provides methods for producing toners and toners produced by such methods. In embodiments, the present disclosure provides processes including contacting a latex, an aqueous colorant dispersion, and an optional wax dispersion to form a blend, heating the blend at a temperature below the glass transition temperature of the latex to form aggregated toner particles, adding a reactive coalescing agent to the toner particles thereby coalescing the toner particles, and recovering said toner particles. Suitable reactive coalescing agents include, in embodiments, glycol esters of vegetable oil fatty acids.

In embodiments, a process of the present disclosure may include contacting a first latex such as a polystyrene-butyl acrylate) having a glass transition temperature from about 45° C. to about 65° C., an aqueous colorant dispersion, and an optional wax dispersion to form a blend, adding a base to increase the pH of the blend to a value of from about 4 to about 7, heating the blend at a temperature from about 30° C. to about 60° C. to form an aggregated toner core, adding a second latex including a poly(styrene-butyl acrylate) having a glass transition temperature from about 45° C. to about 70° C. to the aggregated toner core to form a shell over the toner core and thus thereby forming core-shell toner particles, adding a reactive coalescing agent including a glycol ester of a vegetable oil fatty acid to the toner particles thereby coalescing the toner particles, heating the core-shell toner at a temperature from about 80° C. to about 120° C., and recovering the resulting toner. In embodiments, the process further includes adding a second latex to the aggregated toner particles to form a shell over said aggregated toner particles thereby forming a core-shell toner. The latex polymer and the second latex may be the same or different.

The present disclosure also encompasses toners and toner particles. In embodiments, the present disclosure includes toners including a latex, a colorant, a reactive coalescing agent including a glycol ester of a vegetable oil fatty acid and an optional wax, wherein the latex, colorant, reactive coalescing agent, and optional wax form toner particles.

DETAILED DESCRIPTION OF EMBODIMENTS

The present disclosure provides processes for the preparation of toner particles having narrow size distribution, desirable surface area, and excellent charging characteristics. The processes of the present disclosure may be especially useful in preparing emulsion aggregation toners. In embodiments, the present disclosure utilizes a reactive coalescent, sometimes referred to herein in embodiments, for example, as a reactive coalescing agent, during the aggregation/coalescence stage of the emulsion aggregation process to produce toner particles having uniform particle size, optimal surface area and morphology, as well as triboelectric robustness, for example the ability to retain a uniform triboelectric charge. These properties may help lower key toner failure modes in an apparatus utilizing such a toner, and also increase productivity and reduce the unit manufacturing cost (UMC) for the toner.

The use of the reactive coalescing agent may reduce the time required for coalescence and coalescence may occur at a lower temperature compared with a toner prepared without a reactive coalescing agent. Only a small amount of reactive coalescent, in embodiments from about 0.1 to about 5 weight % based on solids, may be necessary to obtain these advantages.

In embodiments, the present disclosure includes the preparation of toner by blending a colorant and a wax with a latex polymer core, optionally with a flocculant and/or charge additives, and heating the resulting mixture at a temperature below the glass transition temperature (Tg) of the latex polymer to form toner sized aggregates. A second latex may then be added as a shell latex, followed by the addition of a base and cooling. A reactive coalescing agent may be added during this cooling step in amounts of from about 0.1 percent by weight of the solids to about 5 percent by weight of the solids. Subsequently heating the resulting aggregate suspension at a temperature at or above the Tg of the latex polymer will result in coalescence or fusion of the core and shell, after which the toner product may be isolated, such as by filtration, and thereafter optionally washed and dried, such as by placing in an oven, fluid bed dryer, freeze dryer, or spray dryer.

Toners of the present disclosure may include a latex in combination with a pigment. While the latex may be prepared by any method within the purview of one skilled in the art, in embodiments the latex may be prepared by emulsion polymerization methods and the toner may include emulsion aggregation toners. Emulsion aggregation involves aggregation of both submicron latex and pigment particles into toner size particles, where the growth in particle size is, for example, in embodiments from about 3 microns to about 10 microns.

Any monomer suitable for preparing a latex emulsion can be used in the present processes. Suitable monomers useful in forming the latex emulsion, and thus the resulting latex particles in the latex emulsion include, but are not limited to, styrenes, acrylates, methacrylates, butadienes, isoprenes, acrylic acids, methacrylic acids, acrylonitriles, mixtures thereof, and the like.

In embodiments, the resin of the latex may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), polystyrene-butyl acrylate-acrylononitrile), poly(styrene-butyl acrylate-acrylonitrile-acrylic acid), poly (styrene-butadiene), poly(styrene-isoprene), poly(styrene-isoprene-acrylic acid), polystyrene-butyl methacrylate), poly (styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and mixtures and combinations thereof. The polymer may be block, random, or alternating copolymers. In addition, polyester resins obtained from the reaction of bisphenol A and propylene oxide or propylene carbonate, and in particular including such polyesters followed by the reaction of the resulting product with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol, may also be used.

In embodiments, a poly(styrene-butyl acrylate) may be utilized as the latex.

The glass transition temperature of the first latex, which in embodiments may be used to form the core of a toner of the present disclosure, may be from about 45° C. to about 65° C., in embodiments from about 48° C. to about 62° C.

In embodiments, the latex may be prepared in an aqueous phase containing a surfactant or co-surfactant. Surfactants which may be utilized in the latex dispersion can be ionic or nonionic surfactants in an amount of from about 0.01 to about 15 weight percent of the solids, and in embodiments of from about 0.1 to about 5 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., mixtures thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and C12, C15, C17 trimethyl ammonium bromides, mixtures thereof, and the like. Other cationic surfactants include cetyl pyridinium bromide, halide salts of quaternized polyoxyethylalkylamines, dodecylbenzyl triethyl ammonium chloride, MIRAPOL® and ALKAQUAT™ available from Alkaril Chemical Company, SANISOL™ (benzalkonium chloride), available from Kao Chemicals, and the like, and mixtures thereof. In embodiments a suitable cationic surfactant includes SANISOL™ B-50 available from Kao Corp., which is primarily a benzyl dimethyl alkonium chloride.

Examples of nonionic surfactants include, but are not limited to alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, mixtures thereof, and the like. In embodiments commercially available surfactants from Rhone-Poulenc such as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897® can be selected.

The choice of particular surfactants or combinations thereof as well as the amounts of each to be used are within the purview of those skilled in the art.

In embodiments initiators may be added for formation of the latex. Examples of initiators include water soluble initiators, such as ammonium persulfate, sodium persulfate and potassium persulfates, and organic soluble initiators including organic peroxides and azo compounds including Vazo peroxides, such as VAZO 64™, 2-methyl 2-2'-azobis propanenitrile, VAZO 88™, and 2-2'-azobis isobutyramide dehydrate and mixtures thereof. Initiators can be added in suitable amounts, such as from about 0.1 to about 8 weight percent of the monomers, and in embodiments of from about 0.2 to about 5 weight percent of the monomers.

In embodiments, chain transfer agents may be utilized including dodecane thiol, octane thiol, carbon tetrabromide, mixtures thereof, and the like, in amounts from about 0.1 to about 10 percent by weight of the monomers and, in embodiments, from about 0.2 to about 5 percent by weight of the monomers, to control the molecular weight properties of the polymer when emulsion polymerization is conducted in accordance with the present disclosure.

In some embodiments a pH titration agent may be added to control the rate of the emulsion aggregation process. The pH titration agent utilized in the processes of the present disclosure can be any acid or base that does not adversely affect the products being produced. Suitable bases can include metal hydroxides, such as sodium hydroxide, potassium hydroxide, ammonium hydroxide, and optionally mixtures thereof. Suitable acids include nitric acid, sulfuric acid, hydrochloric acid, citric acid, acetic acid, and optionally mixtures thereof.

In the emulsion aggregation process, the reactants may be added to a suitable reactor, such as a mixing vessel. The appropriate amount of at least two monomers, in embodiments from about two to about ten monomers, stabilizer, surfactant(s), initiator, if any, chain transfer agent, if any, and wax, if any, and the like may be combined in the reactor and the emulsion aggregation process may be allowed to begin. Reaction conditions selected for effecting the emulsion polymerization include temperatures of, for example, from about 45° C. to about 120° C., in embodiments from about 60° C. to about 90° C. In embodiments the polymerization may occur at elevated temperatures within about 10 percent of the melting point of any wax present, for example from about 60° C. to about 85° C., in embodiments from about 65° C. to about 80° C., to permit the wax to soften thereby promoting dispersion and incorporation into the emulsion.

Nanometer size particles may be formed, from about 50 nm to about 800 nm in volume average diameter, in embodiments from about 100 nm to about 400 nm in volume average diameter as determined, for example, by a Brookhaven nanosize particle analyzer.

After formation of the latex particles, the latex particles may be utilized to form a toner. In embodiments, the toners are an emulsion aggregation type toner that are prepared by the aggregation and fusion of the latex particles of the present disclosure with a colorant, and one or more additives such as surfactants, coagulants, waxes, surface additives, and optionally mixtures thereof.

The latex particles may be added to a colorant dispersion. The colorant dispersion may include, for example, submicron colorant particles of a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or mixtures thereof. In embodiments, the surfactant may be ionic and may be from about 1 to about 25 percent by weight of the colorant, and in embodiments from about 4 to about 15 percent by weight of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants, and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, copper tetra(octadecyl sulfonamido) phthalocyanine, x-copper phthalocyanine pigment listed in the Color Index as Cl 74160, Cl Pigment Blue, Anthrathrene Blue identified in the Color Index as Cl 69810, Special Blue X-2137, diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight of the toner, in embodiments from about 5 to about 20 weight percent of the toner.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone, sometimes referred to herein as PR-122), Pigment Red 185, Pigment Red 192, Pigment Red 202, Pigment Red 206, Pigment Red 235, Pigment Red 269, and the like, and combinations thereof, may be utilized as the colorant. Pigment PR-122 (2,9-dimethylquinacridone) has been widely used in the pigmentation of toners, plastics, ink, and coatings, due to its unique magenta shade. The chemical structures of PR-122, Pigment Red 269, and Pigment Red 185 are set forth below.

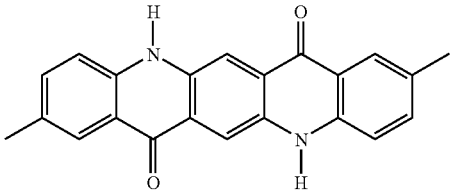

Pigment PR 122 (2,9-dimethylquinacridone)

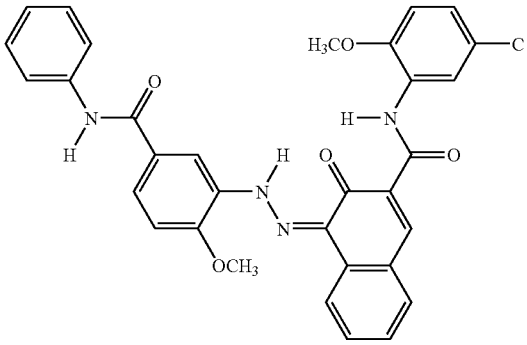

Pigment Red 269

-continued

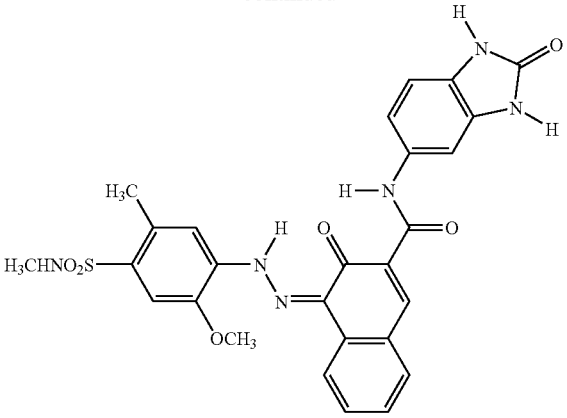

Pigment Red 185

Wax dispersions may also be added to toners of the present disclosure. Suitable waxes include, for example, submicron wax particles of a size of from about 50 to about 500 nanometers in volume average diameter, in embodiments of from about 100 to about 400 nanometers in volume average diameter, suspended in an aqueous phase of water and an ionic surfactant, nonionic surfactant, or mixtures thereof. Suitable surfactants include those described above. The ionic surfactant or nonionic surfactant may be present in an amount of from about 0.5 to about 10 percent by weight of the wax, and in embodiments of from about 1 to about 5 percent by weight of the wax.

The wax dispersion according to embodiments of the present disclosure may include, for example, a natural vegetable wax, natural animal wax, mineral wax, synthetic wax, and combinations thereof. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and mixtures thereof.

Examples of polypropylene and polyethylene waxes include those commercially available from Allied Chemical and Baker Petrolite, wax emulsions available from Michelman Inc. and the Daniels Products Company, EPOLENE® N-15 commercially available from Eastman Chemical Products, Inc., VISCOL® 550-P, a low weight average molecular weight polypropylene available from Sanyo Kasel K.K., and similar materials. In embodiments, commercially available polyethylene waxes may possess a molecular weight (Mw) of from about 1,000 to about 1,500, and in embodiments of from about 1,250 to about 1,400, while the commercially available polypropylene waxes may have a molecular weight of from about 4,000 to about 5,000, and in embodiments of from about 4,250 to about 4,750.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL® 74, 89, 130, 537, and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 1 to about 30 percent by weight of the toner, and in embodiments from about 2 to about 20 percent by weight of the toner.

In embodiments, it may be advantageous to include a stabilizer when forming the latex particles and/or combining the latex particles with the colorant dispersion and the optional wax dispersion. Suitable stabilizers include monomers having carboxylic acid functionality. Such stabilizers may be of the following formula (I):

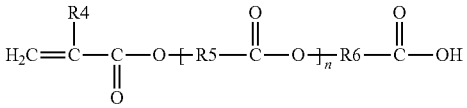

(I)

where R4 may be hydrogen or a methyl group; R5 and R6 may be the same or different and are independently selected from alkyl groups containing from about 1 to about 12 carbon atoms or a phenyl group; n is from about 0 to about 20, in embodiments from about 1 to about 10. Examples of such stabilizers include beta carboxyethyl acrylate (β-CEA), poly (2-carboxyethyl) acrylate, 2-carboxyethyl methacrylate, and the like. Other stabilizers which may be utilized include, for example, acrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.05 to about 5 percent by weight of the stabilizer having carboxylic acid functionality, in embodiments from about 0.8 to about 2 percent by weight of the stabilizer having carboxylic acid functionality.

Where present, the stabilizer may be added in amounts from about 0.01 to about 5 percent by weight of the toner, in embodiments from about 0.05 to about 2 percent by weight of the toner.

In embodiments, a coagulant may be added during or prior to aggregating the latex and the aqueous colorant dispersion. The coagulant may be added over a period of time from about 1 to about 20 minutes, in embodiments from about 1.25 to about 8 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to be of the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.02 to about 2 percent by weight of the toner, and in embodiments from about 0.1 to about 1.5 percent by weight of the toner.

Any aggregating agent capable of causing complexation might be used in forming toner of the present disclosure. Both alkali earth metal or transition metal salts can be utilized as aggregating agents. In embodiments, alkali (II) salts can be selected to aggregate sodio sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally mixtures thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, mixtures thereof, and the like.

Stabilizers that may be utilized in the toner formulation processes include bases such as metal hydroxides, including sodium hydroxide, potassium hydroxide, ammonium hydroxide, and optionally mixtures thereof. Also useful as a stabilizer is a composition containing sodium silicate dissolved in sodium hydroxide.

The resultant blend of latex, optionally in a dispersion, colorant dispersion, optional wax, optional coagulant, and optional aggregating agent, may then be stirred and heated to a temperature below the Tg of the latex, in embodiments from about 30° C. to about 60° C., in embodiments of from about 45° C. to about 55° C., for a period of time from about 0.2 hours to about 6 hours, in embodiments from about 0.5 hours to about 2.5 hours, resulting in toner aggregates of from about 3 microns to about 15 microns in volume average diameter, in embodiments of from about 4 microns to about 8 microns in volume average diameter.

In embodiments, an optional shell may then be formed on the aggregated particles. Any latex utilized noted above to form the core latex may be utilized to form the shell latex. In embodiments, a styrene-n-butyl acrylate copolymer may be utilized to form the shell latex. In embodiments, the latex utilized to form the shell may have a glass transition temperature of from about 45° C. to about 70° C., in embodiments from about 50° C. to about 65° C.

Where utilized, the shell latex may be applied by any method within the purview of those skilled in the art, including dipping, spraying, and the like. The shell latex may be applied until the desired final size of the toner particles is achieved, in embodiments from about 3 microns to about 12 microns, in other embodiments from about 4 microns to about 8 microns. In other embodiments, the toner particles may be prepared by in-situ seeded semi-continuous emulsion copolymerization of the latex. Thus, in embodiments, the toner particles may be prepared by in-situ seeded semi-continuous emulsion copolymerization of styrene and n-butyl acrylate (BA).

Once the desired final size of the toner particles is achieved, the pH of the mixture may be adjusted with a base to a value of from about 3 to about 7, and in embodiments from about 4 to about 6.8. The base may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to adjust the pH to the desired values noted above. The base may be added in amounts from about 6 to about 25 percent by weight of the mixture, in embodiments from about 10 to about 20 percent by weight of the mixture.

A reactive coalescing agent may then be added to the particles. Suitable reactive coalescing agents include, for example, glycol esters, in embodiments glycol esters of fatty acids obtained from vegetable oils. Suitable glycols include ethylene glycol, polyethylene glycol, propylene glycol, diethylene glycol, dipropylene glycol, combinations thereof, and the like.

Vegetable oils suitable for preparing the fatty acid portion of the glycol ester include, for example, soybean oil, linseed oil, corn oil, sunflower oil, canola oil, rapeseed oil, coconut oil, palm kernel oil, palm oil, cottonseed oil, peanut oil, coconut oil, tung oil and safflower oil, and derivatives and combinations thereof, including genetically modified vegetable oils. In embodiments, the vegetable oil may be a polyunsaturated vegetable oil, including those which are low in C18:3 or higher fatty acids (C18:3 denotes a fatty acid possessing 18 carbon atoms and 3 double bonds). Although any polyunsaturated oil that has sufficiently low levels of C18:3 or higher fatty acids may be suitable, in embodiments a suitable vegetable oil may be safflower oil, sunflower oil or corn oil. In some embodiments, the polyunsaturated vegetable oil may contain less than about 2 percent of C18:3 or higher polyunsaturated fatty acids. In other embodiments, the polyunsaturated vegetable oils may possess less than about 2 percent linolenic acid, in embodiments from about 0.5% to about 1.5% linolenic acid.

In embodiments, the glycol ester reactive coalescing agent may be a stabilized propylene glycol monoester (PGME) mixture. A PGME mixture may include monoesters, diesters, monoglycerides, polyols and alcohols.

In embodiments, suitable reactive coalescing agents which may be utilized include, for example, those of the following formula (II)

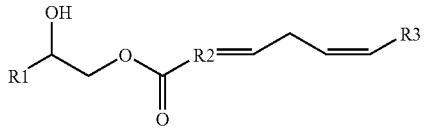

wherein $R_1$ can be hydrogen or a methyl group, $R_2$ can be either alkyl groups having from about 1 to about 12 carbon atoms or a phenyl group, and $R_3$ can be hydrogen, a methyl group, alkyl groups having from about 1 to about 12 carbon atoms, a phenyl group, or a hydroxyl group.

In embodiments, suitable reactive coalescing agents include propylene glycol monoesters of corn oil fatty acids commercially available as ARCHER RC™ from Archer-Daniels-Midland Company (Decatur Ill.). In embodiments, ARCHER RC™ may be utilized as the reactive coalescing agent. The chemical structure of ARCHER RC™ is as follows:

(III)

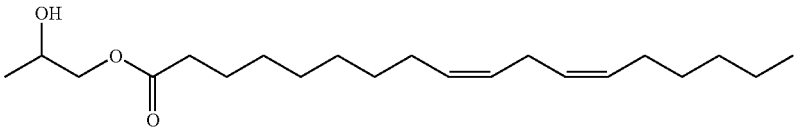

Compared with non-reactive volatile coalescents, this reactive coalescent has a head group similar to trimethylpentanediol monoisobytyrate (sometimes utilized as a coalescent in conventional processes), but the long fatty acid chain makes it reactive and nonvolatile, significantly improving its ability to aid coalecencing and reducing emissions of volatile organic compounds (sometimes referred to herein as "VOC" or "volatiles"). In embodiments, the amount of VOCs released may be from about 1000 ppm to about 75 ppm, in embodiments from about 500 ppm to about 150 ppm.

The amount of reactive coalescing agent added to the particles may be from about 0.1% to about 10% by weight of the particles, in embodiments from about 0.5% to about 5% by weight of the particles.

The mixture of latex, colorant, reactive coalescing agent, and optional wax is subsequently coalesced. Coalescing may include stirring and heating at a temperature of from about 90° C. to about 99° C., in embodiments from about 90.5° C. to about 95° C., for a period of from about 0.5 hours to about 4 hours, and in embodiments from about 0.75 hours to about 3 hours. Coalescing may be accelerated by additional stirring at speeds from about 65 rpm to about 200 rpm, in embodiments from about 90 rpm to about 135 rpm, utilizing any conventional mixer, blender, homogenizer, and the like.

The pH of the mixture may then be lowered to from about 3.5 to about 6 and, in embodiments, to from about 3.7 to about 5.5 with, for example, an acid to assist the coalescence of the toner aggregates. Suitable acids include, for example, nitric acid, sulfuric acid, hydrochloric acid, citric acid or acetic acid. The amount of acid added may be from about 4 to about 30 percent by weight of the mixture, and in embodiments from about 5 to about 15 percent by weight of the mixture.

The mixture is cooled in a cooling or freezing step. Cooling may be at a temperature of from about 20° C. to about 40° C., in embodiments from about 22° C. to about 30° C., over a period time from about 0.5 hour to about 8 hours, and in embodiments from about 1 hours to about 5 hours.

In embodiments, cooling a coalesced toner slurry includes quenching by adding a cooling media such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, nor by the use of jacketed reactor cooling.

In embodiments where a shell latex has been added to form core/shell toner particles, after the above cooling the aggregate suspension may then be heated to a temperature at or above the Tg of the first latex used to form the core and the Tg of the second latex used to form the shell to fuse the shell latex with the core latex. In embodiments, the aggregate suspension may be heated to a temperature from about 80° C. to about 120° C., in embodiments from about 85° C. to about 98° C., for a period of time from about 1 hour to about 6 hours, in embodiments from about 2 hours to about 4 hours, to fuse the shell latex with the core latex.

The toner slurry may then be washed. Washing may be carried out at a pH of from about 7 to about 12, and in embodiments at a pH of from about 9 to about 11. The washing may be at a temperature of from about 30° C. to about 70° C., and in embodiments from about 40° C. to about 60° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

The resulting toner particles may possess the reactive coalescing agent(s) in amounts from about 0.1 to about 10 percent by weight of the toner particles, in embodiments from about 0.5 to about 5 percent by weight of the toner particles.

The toner may also include charge additives in effective amounts of, for example, from about 0.1 to about 10 weight percent of the toner, in embodiments from about 0.5 to about 7 weight percent of the toner. Suitable charge additives include alkyl pyridinium halides, bisulfates, the charge control additives of U.S. Pat. Nos. 3,944,493, 4,007,293, 4,079,014, 4,394,430, and 4,560,635, the entire disclosures of each of which are hereby incorporated by reference in their entirety, negative charge enhancing additives like aluminum complexes, any other charge additives, mixtures thereof, and the like.

Further optional additives which may be combined with a toner include any additive to enhance the properties of toner compositions. Included are surface additives, color enhancers, etc. Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 10 weight percent of the toner, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight of the toner, in embodiments from about 0.1 to about 2 percent by weight of the toner. These additives can be added during the aggregation or blended into the formed toner product.

Toner in accordance with the present disclosure can be used in a variety of imaging devices including printers, copy machines, and the like. The toners generated in accordance with the present disclosure are excellent for imaging processes, especially xerographic processes and are capable of providing high quality colored images with excellent image resolution, acceptable signal-to-noise ratio, and image uniformity. Further, toners of the present disclosure can be selected for electrophotographic imaging and printing processes such as digital imaging systems and processes.

Toner particles produced utilizing a latex of the present disclosure may have a size of about 1 micron to about 20 microns, in embodiments about 2 microns to about 15 microns, in embodiments about 3 microns to about 7 microns. Toner particles of the present disclosure may have a circularity of from about 0.9 to about 0.99, in embodiments from about 0.92 to about 0.98.

Toner particles of the present disclosure may also possess a narrow particle size distribution with a volume-average particle size distribution (GSDv) of from about 1.15 to about 1.45, in embodiments from about 1.175 to about 1.275.

Particles of the present disclosure have optimal surface area, including a lower BET. The BET of the particles is the specific surface area of the particles as determined using the BET (Brunauer, Emmett, Teller) method. The BET method employs nitrogen as an adsorbate to determine the surface area of the toner particles. Briefly, the BET method includes introducing a suitable amount of the toner particles into a BET tube, in embodiments from about 0.5 grams to about 1.5 grams, and then degassing the sample using flowing nitrogen at a temperature from about 25° C. to about 35° C. for a period of time from about 12 hours to about 18 hours prior to analysis. The multi point surface area may be determined using nitrogen as the adsorbate gas at about 70 Kelvin to about 84 Kelvin ($LN_2$), over a relative pressure range of from about 0.1 to about 0.4, in embodiments from about 0.15 to about 0.3. A cross-sectional area of the nitrogen adsorbate of about 15 square angstroms to about 17 square angstroms, in embodiments about 16.2 square angstroms, may be used to calculate surface area. In embodiments, the BET data may also be determined and calculated at a relative pressure of about 0.2 to about 0.4, in embodiments about 0.3. Various apparatus are commercially available for conducting this analysis and determining the BET of the particles. One example of such an apparatus is a TriStar 3000 Gas Adsorption Analyzer from Micromeritics Instrument Corporation (Norcross, Ga.).

It has been found that toners prepared with the latex of the present disclosure have significantly lower particle BETs of from about 1 $m^2/g$ to about 5 $m^2/g$, in embodiments from about 1.2 $m^2/g$ to about 2 $m^2/g$, as well as a narrow distribution of BET values with a variation of from about 0.1 to about 1 $m^2/g$ from batch to batch, in embodiments a variation as low as about 0.2 $m^2/g$ from batch to batch, due to the increase in the latex hydrophobicity and the resulting improved compatibility of resins with pigments.

Toners prepared with the latexes of the present disclosure thus avoid problems found with high particle BET and BET variability, including triboelectric variability and cleaning problems in engines that use emulsion aggregation toners.

A stable triboelectric charge is very important to enable good toner performance. One of the biggest challenges with current toners, including current magenta formulations, is controlling the parent particle BET. A high BET may result in unstable (low) triboelectric charging, and over-toning, as well as cleaning blade filming problems. Utilizing the processes of the present disclosure, one may be able to shorten the production time of a toner possessing excellent BET, which in turn permits excellent control of the charging characteristics of the resulting toner.

Toners of the present disclosure may possess a positive triboelectric charge. In embodiments, toners of the present disclosure may possess a triboelectric charge from about 20 to about 100 microcoulombs per gram, in embodiments from about 30 to about 60 microcoulombs per gram.

The melt flow index (MFI) of toners produced in accordance with the present disclosure may be determined by methods within the purview of those skilled in the art, including the use of a plastometer. Melt flow index is an accurate reflection of the rheology, or viscoelasticity, of the toners used to develop a print. For example, the MFI of the toner may be measured on a Tinius Olsen extrusion plastometer at from about 125° C. to about 135° C. with from about 5 kilograms to about 20 kilograms load force. Samples may then be dispensed into the heated barrel of the melt indexer, equilibrated for an appropriate time, in embodiments from about five minutes to about seven minutes, and then the load force of about 5 kg may be applied to the melt indexer's piston. The applied load on the piston forces the molten sample out a predetermined orifice opening. The time for the test may be determined when the piston traveled one inch. The melt flow may be calculated by the use of the time, distance, and weight volume extracted during the testing procedure.

MFI as used herein thus includes, in embodiments, for example, the weight of a toner (in grams) which passes through an orifice of length L and diameter D in a 10 minute period with a specified applied load. In accordance with the present disclosure, the conditions for determining the MFI of a toner may be a temperature of about 130° C. and an applied load of about 16.6 kilograms. An MFI unit of 1 thus indicates that only 1 gram of the toner passed through the orifice under the specified conditions in 10 minutes time. "MFI units" as used herein thus refers to units of grams per 10 minutes.

Toners produced with the latex of the present disclosure have a melt flow index (MFI) of from about 5 gm/10 min to about 50 gm/10 min, and in embodiments, of from about 8 gm/10 min to about 35 gm/10 min.

Following the methods of the present disclosure, toner particles produced in accordance with the methods of the present disclosure possess lower BET, excellent ability to retain a triboelectric charge, and a narrow particle size distribution. Compared with toners prepared with conventional emulsion aggregation latexes, the toner particles of the present disclosure offer several advantages: (1) intrinsic particles' BET is lower under the same process conditions; (2) increases the robustness of the particles' triboelectric charging through better particle BET control, which reduces the toner defects and improves the machine performance; (3) easy to implement, no major changes to existing aggregation/coalescence processes; (4) and increases productivity and reduces unit manufacturing cost (UMC) by reducing the production time and the need for rework (quality yield improvement).

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer includes conductive carrier particles and is capable of conducting an electric current between the biased magnet through the carrier particles to the photoreceptor.

Imaging methods are also envisioned with the toners disclosed herein. Such methods include, for example, some of the above patents mentioned above and U.S. Pat. Nos. 4,265,990, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

About 258 grams of a polystyrene-co-n-butyl acrylate-beta-carboxyethyl acrylate latex, having about 41% solids content, with a particle size (D50) of about 200 nm measured by a Microtrac Ultra Fine Particle Analyzer Model Number 150 from MicroTrac, Inc., and a Mw of about 38 k measured by gel permeation chromatography (GPC) using a Waters 2690 Separation Module, with a Waters 410 Differential Refractometer (from Waters Corporation), was combined with about 80.3 grams pigment dispersion PR 122 (a magenta pigment), about 20.1 grams PR 185 pigment dispersion (PR 185 is a magenta pigment), about 60 grams of crystalline polyethylene wax dispersion commercially available as POLYWAX 725® from Baker-Petrolite, and about 670 grams of de-ionized water by addition to a 2 L stainless steel reactor, and mixed by a bench homogenizer (Model ULTRA-TURRAX® T50 Basic from IKA®-Works (Wilmington, N.C.)) for about 15 minutes at about 20° C.

About 2.2 grams of poly(aluminum chloride) in about 20 grams of about 0.02 N nitric acid was added dropwise over a period of about eight minutes. The resulting viscous mixture was continuously mixed by homogenizer for about another 20 minutes. Then the mixture was stirred by a mechanical stirrer at about 550 rpm, and the temperature of the mixture was raised to about 50° C. over a period of about 35 minutes. After the particles reached a size of about 6.2 microns in diameter (as determined by a Layson cell/Multisizer measurement system), about 140 grams of a shell latex (the same polystyrene-co-n-butyl acrylate-beta-carboxyethyl acrylate latex described above) was added dropwise over a period of about 10 minutes. After particle size reached about 7.2 microns, the pH of the solution was adjusted to about 4.5 by the addition of about 4% by weight of a sodium hydroxide solution. After about 10 minutes, about 2 grams of a reactive coalescent, a propylene glycol monoester commercially available as ARCHER RC™ from Archer-Daniels-Midland Company (Decatur Ill.) was added. After about 20 minutes, the temperature of the mixture was raised to about 94° C. over a period of about 35 minutes, and the pH of the mixture was adjusted to about 4 by the addition of 0.3 N nitric acid. After stirring at a temperature of about 94° C. at about 130 rpm for about 60 minutes, the mixture was then cooled down to about 53° C., and the pH was adjusted to about 10 by the addition of about 4% by weight sodium hydroxide solution as the temperature of the mixture decreased to about 20° C. After washing with de-ionized water, 0.3 N nitric acid and a second washing with de-ionized water, the particles were dried at about 45° C. The resulting toner product had a volume median particle size of about 7.06 microns, with a circularity of about 0.978, and a volume-average particle size distribution (GSDv) of about 1.193, as determined by a Coulter Counter Multisizer II particle sizer.

Example 2

A magenta toner particle was prepared using the same formulation and process conditions as set forth above in Example 1, except that no coalescing agent was added, and the preparation utilized a higher coalescence temperature (about 96° C.) and a longer coalescence time (about 4.5 hr). The volume median particle size, circularity and volume-average particle size distribution (GSDv) of the resulting toner particles was determined by a Coulter Counter Multisizer II particle sizer as described above in Example 1.

A multi point BET (Brunauer, Emmett, Teller) method employing nitrogen as the adsorbate was used to determine the surface area of the toner particles of both this control toner and the toner of the present disclosure prepared in accordance with Example 1 above. Approximately one gram of the sample was accurately weighed into a BET tube. The sample was degassed using flowing nitrogen at about 30° C. on a VacPrep 061 (available from Micromeritics Instrument Corporation of Norcross, Ga.) for a period of time from about 12 hours to about 18 hours prior to analysis. The multi point surface area was determined using nitrogen as the adsorbate gas at about 77 Kelvin ($LN_2$), over the relative pressure range of about 0.15 to about 0.3. The cross-sectional area of the nitrogen adsorbate used in the calculation was about 16.2 square angstroms. The single point BET data was also reported and was calculated at a relative pressure of approximately 0.3. The sample was analyzed on a TriStar 3000 Gas Adsorption Analyzer from Micromeritics Instrument Corporation (Norcross, Ga.).

Melt Flow Index was determined by measuring the weight of a toner (in grams) which passes through an orifice of length L and diameter D in about a 10 minute period with a specified applied load of about 16.6 kg. The Tinius Olsen melt indexer instrument was utilized. The instrument's desired sample temperature set point was set to about 130° C., with the proper applied load force of about 16.6 kg. The sample was then dispensed into the heated barrel of the melt indexer, equilibrated for about six (6) minutes, and the specified load force was then applied to the melt indexer's piston. The applied load caused the downward motion of the piston forcing the molten sample out a pre-determined orifice opening. The time was determined when a pre determined one (1) inch of travel by the piston was measured. The melt flow was calculated by the use of the time, distance, and weight volume extracted during the testing procedure.

The triboelectric charge was determined by taking about 2.4 grams of toner and blending it with about 30 grams of a FC276 carrier commercially available from Suzuka Fuji Xerox (SFX). The blending was performed in four ounce glass jars. The blending of the toner and carrier components resulted in an interaction where the toner particles became negatively charged and carrier particles became positively charged. Samples of the resulting mixture were loaded into a Robot Cage manufactured by Xerox Corporation and weighed. Via instrument air and a vacuum source, the toner was removed from the carrier, while the carrier was retained by the screened Robot Cage. The residual charge on the carrier was detected by an electrometer manufactured by Keithley Instruments Inc. in Coulombs (relating to the triboelectric charge). The residual charge and the weight of toner blown off was used to calculate the triboelectric charge (Tribo). Using the weights of toner blown off and retained carrier, the toner concentration was calculated as follows.

$$\text{Tribo}(Q/m)=Q/W_t;$$

Where Q=charge in μCoulombs $W_t$=weight of toner.

A total of three samples from Example 1 (referred to as Examples 1A, 1B, and 1C) were tested to determine the consistency of the results. The results of the BET, MFI, and the other properties of the toner particles are summarized below in Table 1.

TABLE 1

Comparison of Magenta Toner Particle Properties

| Sample | Reactive Coalescent | Particle Size (um) | GSDv | Circularity | Coalescence Temp. (° C.) | Coalescence time (hr) | MFI (g/10 min) | BET (multi point) ($m^2/g$) | Tribo (mC/g) |
|---|---|---|---|---|---|---|---|---|---|
| Example 1A | Archer RC | 7.06 | 1.193 | 0.978 | 94 | 1 | 8.9 | 1.45 | 41.2 |
| Example 1B | Archer RC | 6.87 | 1.12 | 0.98 | 94 | 1 | 9.23 | 1.38 | 42.3 |
| Example 1C | Archer RC | 7.14 | 1.211 | 0.976 | 94 | 1 | 9.05 | 1.47 | 41.9 |
| Example 2 | No | 7.04 | 1.255 | 0.971 | 96 | 4.5 | 8.99 | 2.38 | 34.6 |

For the control toner of Example 2, a circularity of about 0.971 was achieved after about 4.5 hours, with a particle size of about 7.04 microns, and a GSDv of about 1.255. As can be seen from the above Table 1, the variability from the three samples possessing the reactive coalescent was minimal.

Compared with the control toner of Example 2 (without coalescence agent), the toner of the present disclosure prepared with a reactive coalescing agent as set forth in Example 1 required a significantly reduced coalescence time (only about 1 hour coalescence for about 0.978 magenta particle circularity, compared with about 4 to about 5 hours coalescence for 0.971 particle circularity) at an even lower coalescence temperature (about 94° C. for Example 1 instead of about 96° C. for the control). The toner particles of the present disclosure produced in accordance with Example 1 also demonstrated narrower volume-average particle size distribution (GSDv) and lower BET. Finally, the melt flow index (MFI) for the toner of the present disclosure compared to the control toner were almost the same, indicating that the small amount of coalescence agent added during the aggregation/coalescence process had a minimal effect on the other toner properties.

The identification of volatiles in the samples of Example 1 and Example 2 was performed utilizing head space gas chromatography/mass spectrometry (GC/MS) in an HP 6890 from Hewlett Packard. The two toner samples were very similar with regards to volatiles present in the samples, suggesting that using reactive coalescing agent during the aggregation/coalescence process would not introduce additional volatile compounds into the toner.

Example 3

The toners of Example 1 were scaled up for production in two 20 gallon batches with the same reactive coalescent of Example 1 and tested utilizing the same methods described above in Example 2. The amounts of reactants were as follows: about 12.9 kilograms of a polystyrene-co-n-butyl acrylate-beta-carboxyethyl acrylate latex; about 2.7 kilograms of a pigment dispersion PR 122 (a magenta pigment); about 2.7 kilograms PR 185 pigment dispersion (PR 185 is a magenta pigment); about 3.7 kilograms of crystalline polyethylene wax dispersion commercially available as POLYWAX 725® from Baker-Petrolite; about 30 kilograms of de-ionized water; about 180 grams of poly(aluminum chloride) in about 1620 grams of about 0.02 N nitric acid; about 6.9 kilograms of a shell latex (the same polystyrene-co-n-butyl acrylate-beta-carboxyethyl acrylate latex described above); about 500 grams of a reactive coalescent, a propylene glycol monoester commercially available as ARCHER RC™ from Archer-Daniels-Midland Company (Decatur Ill.). The reaction conditions, including temperatures, pH, etc. from Example 1 were utilized in this Example. No process issues were observed.

Toners prepared without reactive coalescing agent were utilized as controls. Two samples of the toners of this Example were prepared. The first sample utilized a PR 122 pigment from DNS (Examples 3A and Control A); the second sample utilized a PR 122 pigment, Sun 6832 PR122 pigment from Sun (Examples 3B and Control B).

TABLE 2

Comparison of Magenta Parent Particle Properties (20-GaL data)

| Sample | Reactive Coalescent | Particle Size (um) | GSDv | Circularity | Coalescence Temp. (° C.) | Coalescence time (min) | MFI (g/10 min) | BET (multi point) ($m^2/g$) | Tribo (mC/g) |
|---|---|---|---|---|---|---|---|---|---|
| Example 3A | Archer RC | 6.11 | 1.211 | 0.963 | 96 | 90 | 28.9 | 1.65 | 40.1 |
| Control A | No | 6.19 | 1.233 | 0.961 | 96 | 270 | 29.7 | 2.29 | 38.8 |
| Example 3B | Archer RC | 6.25 | 1.22 | 0.96 | 96 | 90 | 29.7 | 1.69 | 36.7 |
| Control B | No | 6.17 | 1.218 | 0.953 | 96 | 270 | 28.3 | 4.29 | 26.9 |

The results set forth in Table 2 above demonstrate the feasibility of practicing the present disclosure on a commercial scale.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

contacting a latex polymer, an aqueous colorant dispersion, and an optional wax dispersion to form a blend;

heating the blend at a temperature below the glass transition temperature of the latex polymer to form aggregated toner particles;

adding a coalescing agent to the toner particles thereby coalescing the toner particles, wherein the coalescing agent comprises a glycol ester of a vegetable oil fatty acid; and recovering said toner particles.

2. A process as in claim 1, wherein the glycol component of the glycol ester of a vegetable oil fatty acid is selected from the group consisting of ethylene glycol, propylene glycol, diethylene glycol, dipropylene glycol, polyethylene glycol, and combinations thereof, and the vegetable oil is selected from the group consisting of soybean oil, linseed oil, corn oil, sunflower oil, canola oil, rapeseed oil, coconut oil, palm kernel oil, palm oil, cottonseed oil, peanut oil, coconut oil, tung oil, safflower oil, genetically modified vegetable oils, and combinations thereof.

3. A process as in claim 1, wherein the process further comprises adding a second latex to the aggregated toner particles to form a shell over said aggregated toner particles thereby forming a core-shell toner, adding the coalescing agent to the toner particles, and subsequently heating the core-shell toner with the coalescing agent at a temperature above the glass transition temperature of the latex polymer.

4. A process as in claim 3, wherein the latex polymer and the second latex are the same or different and include a monomer selected from the group consisting of styrenes, acrylates, methacrylates, butadienes, isoprenes, acrylic acids, methacrylic acids, acrylonitriles, and combinations thereof, the latex polymer has a glass transition temperature from about 45° C. to about 65° C., the second latex has a glass transition temperature from about 45° C. to about 70° C.

5. A process as in claim 3, wherein the latex polymer and the second latex are the same or different and are selected from the group consisting of poly(styrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly (styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof.

6. A process as in claim 3, wherein heating the blend occurs at a temperature from about 30° C. to about 60° C. and heating the core-shell toner occurs at a temperature from about 80° C. to about 120° C.

7. A process as in claim 3, wherein the latex polymer and the second latex comprise a poly(styrene-butyl acrylate) and the optional wax is selected from the group consisting of natural vegetable waxes, natural animal waxes, mineral waxes, synthetic waxes, and combinations thereof.

8. A process as in claim 1, wherein adding the coalescing agent comprises adding coalescing agent in an amount from about 0.1% to about 10% by weight of the aggregated toner particles, coalescing the aggregated toner particles occurs over a period of time from about 0.5 hours to about 4 hours so that the resulting toner particles have a size from about 1 micron to about 20 microns, and a volume-average particle size distribution of from about 1.15 to about 1.45.

9. A process as in claim 1, wherein adding the coalescing agent comprises adding coalescing agent in an amount from about 0.5% to about 5% by weight of the aggregated toner particles so that the resulting toner particles possess a triboelectric charge from about 20 to about 100 microcoulombs per gram and a BET surface area from about 1 $m^2/g$ to about 5 $m^2/g$.

10. A process comprising:

contacting a first latex comprising a polystyrene-butyl acrylate) having a glass transition temperature from about 45° C. to about 65° C., an aqueous colorant dispersion, and an optional wax dispersion to form a blend;

adding a base to increase the pH to a value of from about 4 to about 7;

heating the blend at a temperature from about 30° C. to about 60° C. to form an aggregated toner core;

adding a second latex comprising a poly(styrene-butyl acrylate) having a glass transition temperature from about 45° C. to about 70° C. to the aggregated toner core to form a shell over said toner core thereby forming core-shell toner particles;

adding a coalescing agent comprising a glycol ester of a vegetable oil fatty acid to the core-shell toner particles thereby coalescing the core-shell toner particles;

heating the core-shell toner at a temperature from about 80° C. to about 120° C.; and recovering said toner.

11. A process as in claim 10, wherein the glycol component of the glycol ester of a vegetable oil fatty acid is selected from the group consisting of ethylene glycol, propylene glycol, diethylene glycol, dipropylene glycol, polyethylene glycol, and combinations thereof, and the vegetable oil is selected from the group consisting of soybean oil, linseed oil, corn oil, sunflower oil, canola oil, rapeseed oil, coconut oil, palm kernel oil, palm oil, cottonseed oil, peanut oil, coconut oil, tung oil, safflower oil, genetically modified vegetable oils, and combinations thereof.

12. A process as in claim 10, wherein adding the coalescing agent comprises adding coalescing agent in an amount from about 0.1% to about 10% by weight of the core-shell toner particles, coalescing the core-shell toner particles occurs over a period of time from about 0.5 hours to about 4 hours, heating the blend occurs at a temperature from about 45° C. to about 55° C., heating the core-shell toner occurs at a temperature from about 85° C. to about 98° C., and the coalescing agent comprises a propylene glycol monoester of a corn oil fatty acid having the following formula

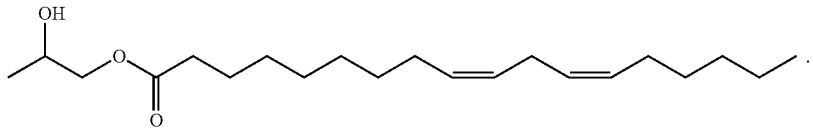

13. A process as in claim 10, wherein adding the coalescing agent comprises adding coalescing agent in an amount from about 0.5% to about 5% by weight of the core-shell toner particles, so that the resulting toner particles have a size from about 1 micron to about 20 microns, a volume-average particle size distribution of from about 1.15 to about 1.45, a triboelectric charge from about 20 to about 100 microcoulombs per gram, and a BET surface area from about 1 $m^2/g$ to about 5 $m^2/g$.

14. A process as in claim 1, wherein the coalescing agent is of the following formula

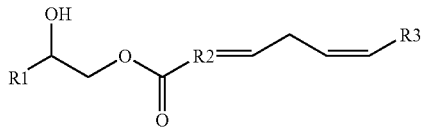

wherein $R_1$ is selected from the group consisting of hydrogen and methyl groups, $R_2$ is selected from the group consisting of alkyl groups having from about 1 to about 12 carbon atoms and phenyl groups, and $R_3$ is selected from the group consisting of hydrogen, methyl groups, alkyl groups having from about 1 to about 12 carbon atoms, phenyl groups and hydroxyl groups.

15. A process as in claim 10, wherein the coalescing agent is of the following formula

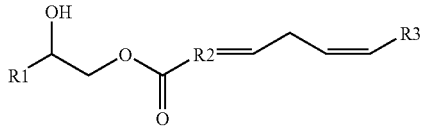

wherein $R_1$ is selected from the group consisting of hydrogen and methyl groups, $R_2$ is selected from the group consisting of alkyl groups having from about 1 to about 12 carbon atoms and phenyl groups, and $R_3$ is selected from the group consisting of hydrogen, methyl groups, alkyl groups having from about 1 to about 12 carbon atoms, phenyl groups and hydroxyl groups.

16. A process as in claim 1, wherein the coalescing agent comprises a propylene glycol monoester of a corn oil fatty acid having the following formula

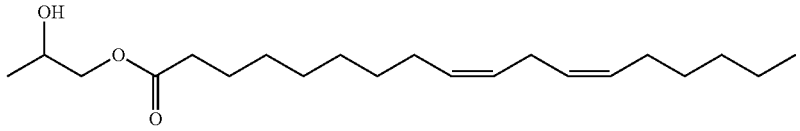

* * * * *